US009150388B2

(12) United States Patent
Yoo et al.

(10) Patent No.: US 9,150,388 B2
(45) Date of Patent: Oct. 6, 2015

(54) HOIST APPARATUS

(71) Applicant: SAMSUNG ELECTRONICS CO., LTD., Suwon-si, Gyeonggi-do (KR)

(72) Inventors: Byung-kook Yoo, Suwon-si (KR); Young-hoon Lee, Seongnam-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 265 days.

(21) Appl. No.: 13/764,955

(22) Filed: Feb. 12, 2013

(65) Prior Publication Data

US 2013/0269564 A1 Oct. 17, 2013

(30) Foreign Application Priority Data

Apr. 17, 2012 (KR) ..... 10-2012-0039971

(51) Int. Cl.
*B66C 7/02* (2006.01)
*B66C 9/06* (2006.01)

(52) U.S. Cl.
CPC .... *B66C 7/02* (2013.01); *B66C 9/06* (2013.01)

(58) Field of Classification Search
CPC ..... B66C 7/02; B66C 9/06
USPC ..... 104/91, 94, 95, 96, 98, 130.01, 130.04, 104/130.05, 130.06
See application file for complete search history.

(56) References Cited

U.S. PATENT DOCUMENTS

| | | | | |
|---|---|---|---|---|
| 6,308,818 | B1 * | 10/2001 | Bonora et al. | 198/465.1 |
| 6,494,308 | B2 * | 12/2002 | Bonora et al. | 198/465.2 |
| 7,789,019 | B2 * | 9/2010 | Kato | 104/111 |
| 8,757,401 | B2 * | 6/2014 | Uchino | 212/77 |
| 8,813,653 | B2 * | 8/2014 | Izumi et al. | 104/130.07 |
| 2013/0269564 | A1 * | 10/2013 | Yoo et al. | 104/91 |
| 2014/0090575 | A1 * | 4/2014 | Nagamine et al. | 104/91 |

FOREIGN PATENT DOCUMENTS

| | | | |
|---|---|---|---|
| JP | 2006-005047 | A | 1/2006 |
| JP | 2008-079373 | A | 4/2008 |
| JP | 2010-235212 | A | 10/2010 |
| KR | 10-2001-0054697 | A | 7/2001 |
| KR | 10-2001-0067411 | A | 7/2001 |
| KR | 10-2005-0059551 | A | 6/2005 |
| KR | 10-2009-0024580 | A | 3/2009 |
| KR | 10-2011-0056933 | A | 5/2011 |

* cited by examiner

*Primary Examiner* — Jason C Smith
(74) *Attorney, Agent, or Firm* — Lee & Morse, P.C.

(57) ABSTRACT

A hoist apparatus includes branch guide rails with a branch point, the branch point defining a branching point between first and second traveling rails, and the branch guide rails including first guide rails having a cross-section in a first direction, and second guide rails having a cross-section in a second direction and connected to the first guide rails, and a traveling unit configured to travel along the branch guide rails, the traveling unit including first auxiliary wheels configured to roll and contact a first side of the second guide rails.

19 Claims, 12 Drawing Sheets

HOIST APPARATUS

CROSS-REFERENCE TO RELATED APPLICATION

This application claims under 35 U.S.C. §119 priority to and the benefit of Korean Patent Application No. 10-2012-0039971, filed on Apr. 17, 2012, in the Korean Intellectual Property Office, the disclosure of which is incorporated herein in its entirety by reference.

BACKGROUND

1. Field

The inventive concept relates to a semiconductor hoist apparatus, and more particularly, to a hoist apparatus that may branch out and travel more stably.

2. Description of the Related Art

In general, hoist apparatuses are referred to as apparatuses that hoist and transfer an object. Hoist apparatuses are used in freight transport, and machine assembly/disassembly in factories, warehouses, train stations, and the like. Hoist apparatuses are also used in transferring logistics in factories for semiconductors or display panels, such as liquid crystal displays (LCDs), plasma display panels (PDPs), and the like, and in clean rooms.

SUMMARY

The inventive concept provides a hoist apparatus that may branch out and travel more stably, may reduce shock applied to an object, may prevent an object from escaping from its position by reducing vibration and noise that may occur in traveling, and may increase working efficiency by increasing the speed of branching and traveling.

According to an aspect of the inventive concept, there is provided a hoist apparatus that includes branch guide rails with a branch point, the branch point defining a branching point between first and second traveling rails, and the branch guide rails including first guide rails having a cross-section in a first direction, and second guide rails having a cross-section in a second direction and connected to the first guide rails, and a traveling unit configured to travel along the branch guide rails, the traveling unit including first auxiliary wheels configured to roll and contact a first side of the second guide rails.

The first guide rails may include vertical guide rails having a cross-section extending in a vertical direction, and the second guide rails may include horizontal guide rails having a cross-section extending in a horizontal direction, cross-sections of the first guide rails and the second guide rails being reverse T-shaped.

The first side of the second guide rails may be a top surface of the second guide rails.

The first auxiliary wheels may include vertical wheels that stand in a vertical direction.

The first auxiliary wheels may be at left and right sides of a reciprocating support, the reciprocating support being configured to make a reciprocating movement along a guide selectively.

The traveling unit may further include second auxiliary wheels configured to roll and contact a second side of the second guide rails.

The second side of the second guide rails may be a side surface of the second guide rails, the second auxiliary wheels being horizontal wheels that stand in a horizontal direction.

The second auxiliary wheels may be installed at a reciprocating support, the reciprocating support being configured to make a reciprocating movement along a guide selectively.

The first and second traveling rails of the branch guide rails may include a linear path and a curved path turning away from the linear path, respectively.

The traveling unit may further include a wheel support connected to a traveling leveling cart, left traveling wheels and right traveling wheels at left and right sides of the wheel support, respectively, the left and right traveling wheels being configured to roll and contact the first direction traveling rails or the second direction traveling rails, and a reciprocating support configured to make a reciprocating movement along a guide, the reciprocating support bring on a top surface of the wheel support.

The second guide rails may include inclined surfaces, a thickness of central portions of the second guide rails being gradually reduced toward edges of the second guide rails.

The branch guide rails may be configured by connecting two members having L-shaped cross-sections to a member having a reverse T-shaped cross-section.

The branch guide rails may be configured by connecting two members having L-shaped cross-sections.

The branch guide rails may be configured by hinge-connecting two members having L-shaped cross-sections to a member having a reverse T-shaped cross-section, the two L-shaped members being configured to rotate around hinge shafts of the reverse T-shaped member.

According to another aspect of the inventive concept, there is also provided a hoist apparatus including branch guide rails with a branch point, the branch point defining a branching point between first and second traveling rails, and the branch guide rails including vertical guide rails having a cross-section in a vertical direction, and horizontal guide rails having a cross-section in a horizontal direction and connected to the vertical guide rails, and a traveling unit configured to travel along the branch guide rails, the traveling unit including vertical wheels configured to roll and contact a top surface of the second guide rails, and horizontal wheels configured to roll and contact a side surface of the second guide rails.

According to another aspect of the inventive concept, there is also provided hoist apparatus including branch guide rails with a branch point, the branch point defining a branching point between first and second traveling rails, and the branch guide rails including first guide rails branching into two directions at the branch point, and second guide rails on the first guide rails, the second guide rails branching into two directions at the branch point and being perpendicular to the first guide rails, and a traveling unit configured to travel along the branch guide rails, the traveling unit including auxiliary wheels positioned to contact only one side of the branch guide rails.

The traveling unit may include first and second auxiliary wheels, the first auxiliary wheels contacting only one side surface of the branch guide rails, and the first auxiliary wheels contacting only one top surface of the branch guide rails.

The first and second auxiliary wheels may be at a first side of the traveling unit, the first and second auxiliary wheels being in continuous contact with the branch guide rails.

A second side of the traveling unit may be in non-continuous contact with the branch guide, the second side of the traveling unit being opposite the first side of the traveling unit.

A thickness of the second guide rails may be gradually reduced at terminal edges facing away from the branch point.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
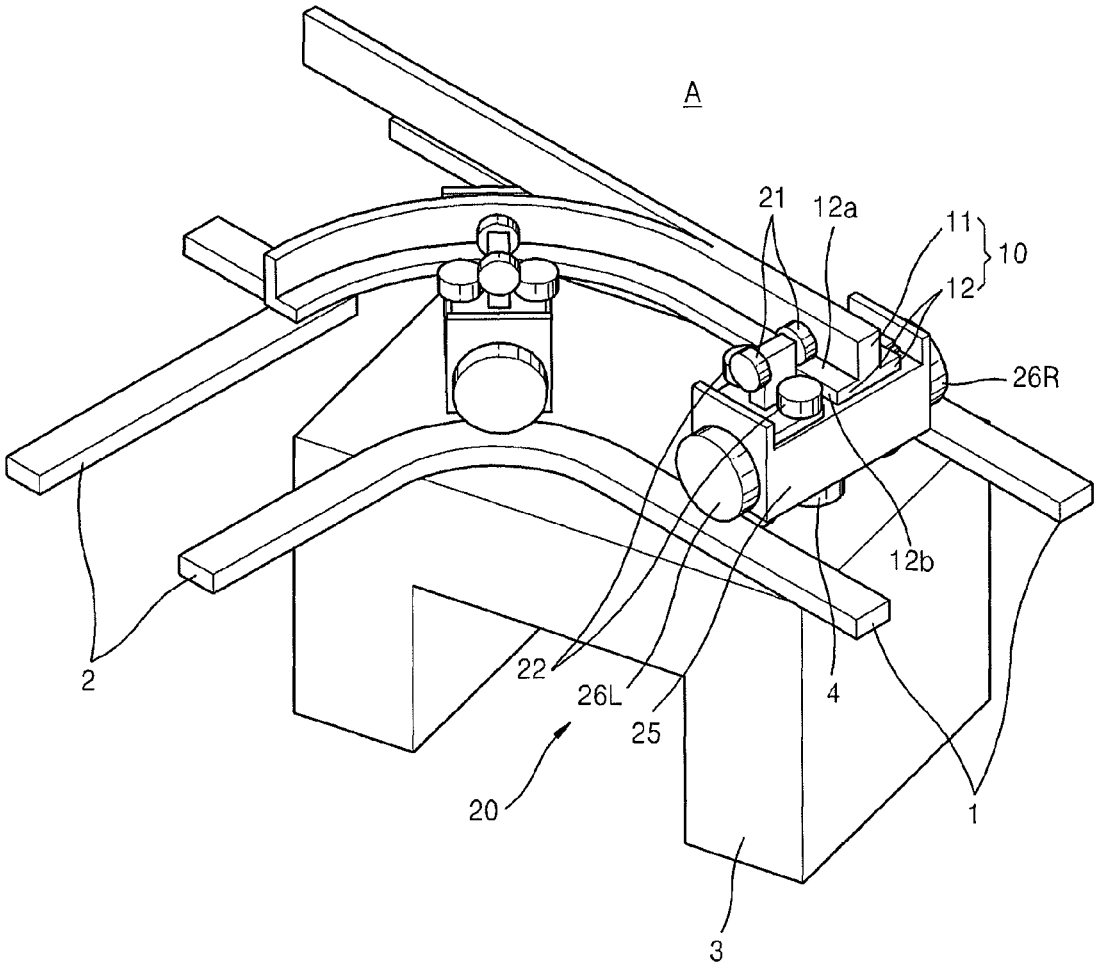
FIG. 1 illustrates a perspective view of a branching and traveling state of a hoist apparatus according to an embodiment of the inventive concept.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when an element, e.g., a layer, is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Further, it will be understood that when an element, such as a layer, a region, or a substrate, is referred to as being "connected to" or "coupled to" another element, it may be directly on, connected to, or coupled to the other element or intervening elements may be present. In contrast, when an element is referred to as being "directly on," "directly connected to" or "directly coupled to" another element, there are no intervening elements or present. This applies to interpretation of other expressions for describing the relationship between elements, i.e., "adjacent to" and "directly adjacent to". Like reference numerals refer to like elements throughout. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms do not refer to a particular order, rank, or superiority and are only used to distinguish one element, component, region, layer, or section from another element, component, region, layer, or section. Thus, a first element, component, region, layer or section discussed below could be termed a second element, component, region, layer, or section without departing from the teachings of the example embodiment. For example, a first element may be referred to as a second element, and similarly, a second element may be referred to as a first element without departing from the scope of protection of the inventive concept.

Spatially relative terms, such as "above" or "upper" and "below" or "lower", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Hereinafter, exemplary embodiments of the inventive concept will be described with reference to accompanying drawings schematically illustrating the embodiments. In the drawings, for example, illustrated shapes may be deformed according to fabrication technology and/or tolerances. Therefore, the exemplary embodiments of the inventive concept are not limited to certain shapes illustrated in the present specification, and may include modifications of shapes caused in fabrication processes.

Figure 2:
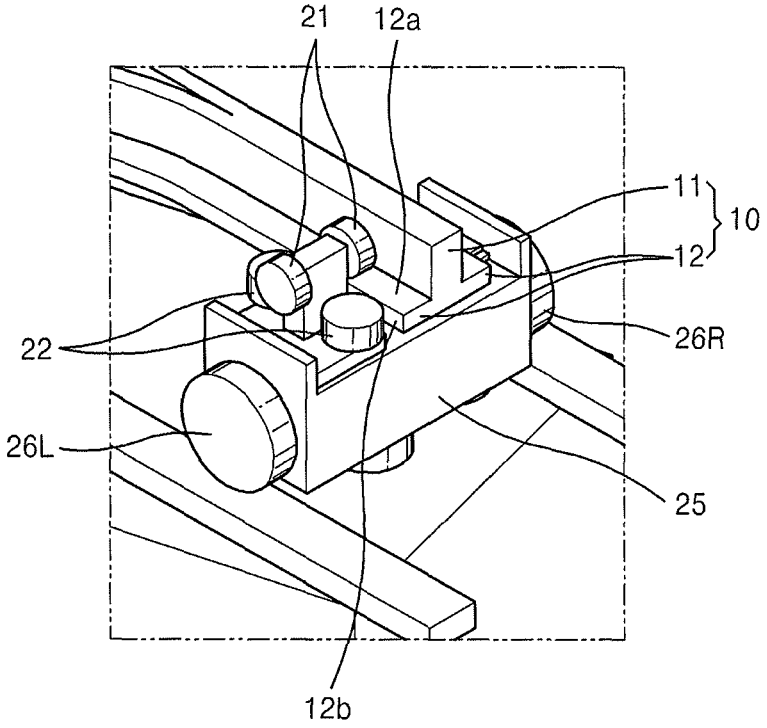
FIG. 2 illustrates an exploded perspective view of branch guide rails and a traveling unit of the hoist apparatus illustrated in FIG. 1.

FIG. 1 is a perspective view of a branching and traveling state of a hoist apparatus according to an embodiment of the inventive concept. FIG. 2 is an exploded perspective view of branch guide rails 10 and a traveling unit 20 of the hoist apparatus illustrated in FIG. 1, and FIG. 3 is a detailed perspective view of the branch guide rails 10 of the hoist apparatus of FIG. 1.

Figure 3:
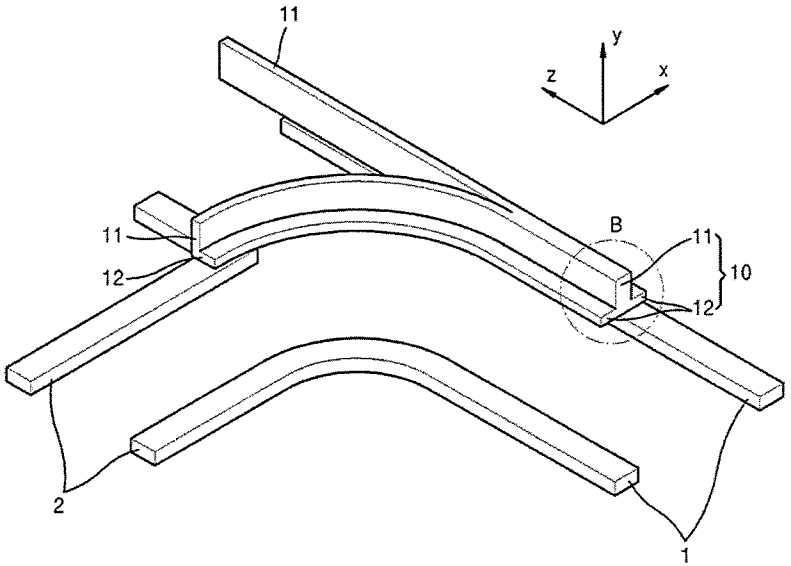
FIG. 3 illustrates a detailed perspective view of the branch guide rails of the hoist apparatus of FIG. 1.

First, as illustrated in FIGS. 1 through 3, the hoist apparatus according to embodiments of the inventive concept may include the branch guide rails 10 and the traveling unit 20. The branch guide rails 10 may include first and second guide rails 11 and 12.

As illustrated in FIG. 3, the first guide rails 11 may be vertical guide rails having a cross-section extending in a vertical direction, e.g., along the y-axis, and the second guide rails 12 may be horizontal guide rails having a cross-section extending in a horizontal direction, e.g., along the x-axis. Thus, a combination of the cross-section of the first guide rails 11 and the cross-section of the second guide rails 12 may define a reverse T-shape or a L-shape. The shapes of the first guide rails 11 and the second guide rails 12 may be diverse and will be described with reference to FIGS. 13 through 15 in more detail. In addition, the first direction traveling rails 1, the second direction traveling rails 2, and the branch guide rails 10 may be usually installed on a ceiling, in the air, on a wall, or the like of a semiconductor line, or a factory.

Figure 4:
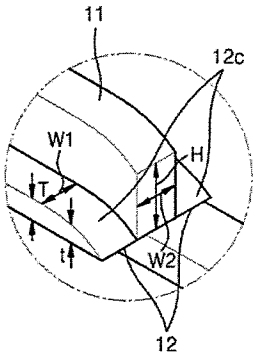
FIG. 4 illustrates a perspective view of front ends of the branch guide rails of portion B of FIG. 3.

FIG. 4 is a perspective view of front ends of the branch guide rails 10 in portion B of FIG. 3, according to an embodiment of the inventive concept. It is noted that while some features in FIG. 3 are illustrated as having flat surfaces, the actual curved shape of such surfaces is further described with reference to the enlarged view in FIG. 4.

As illustrated in FIG. 4, the second guide rails 12 may have inclined surfaces 12*c* where a thickness T of central portions of the second guide rails 12 is relatively large and a thickness t of both ends of the second guide rails 12 is gradually reduced, i.e., so the second guide rails 12 become thinner. In other words, each second guide rail 12 may be positioned along a side surface of the first guide rail 11, and may have a width W1 along the x-axis and a thickness T along the y-axis that is gradually reduced toward a terminal end of the respective second guide rail 12, i.e., along the z-axis. Thus, first auxiliary wheels 21 (FIGS. 1-2) may smoothly roll and contact the front ends of the second guide rails 12, i.e., the terminal edges, along the inclined surfaces 12*c*, i.e., so that vibration and noise during branch may be prevented. It is noted that the thickness T is smaller than a height H of the first guide rail 11, and the height H and width W2 of the first guide rails 11 may be modified in various ways.

In detail, the traveling unit 20 may travel along the branch guide rails 10 and may include the first auxiliary wheels 21 and second auxiliary wheels 22 that roll along the second guide rails 12. The first auxiliary wheels 21 contact and roll along a first side 12*a* of the second guide rails 12, and the second auxiliary wheels 22 contact and roll along a second side 12*b* of the second guide rails 12, as illustrated in FIG. 2. As illustrated in FIG. 2, the first side 12*a* of the second guide rails 12 may be a top surface of the second guide rails 12, and the second side 12*b* of the second guide rails 12 may be a left side or a right side of the second guide rails 12. The first and second sides 12*a* and 12*b* of the second guide rails 12 are perpendicular to each other.

As further illustrated in FIG. 2, the first auxiliary wheels 21 may be vertical wheels that stand in a vertical plane, i.e., a plane defined by the y-axis and z-axis, due to a rotation shaft installed in a horizontal direction and are rotated in the vertical plane so that the first auxiliary wheels 21 roll and contact the top surface of the second guide rails 12. The second auxiliary wheels 22 may be horizontal wheels that lie in the horizontal plane, i.e., a plane defined by the x-axis and z-axis, due to a rotation shaft installed in the vertical direction and are rotated in the horizontal plane so that the second auxiliary wheels 22 roll and contact the left side or right side of the second guide rails 22.

The first auxiliary wheels 21 and the second auxiliary wheels 22 may be formed of an elastic material, e.g., urethane, rubber, polytetrafluoroethylene, e.g., Teflon®, plastic, industrial plastic, resin, or the like, and may have a rounded structure, e.g., a tire, a tube, or the like. For example, an additional elastic structure, e.g., a tire, a tube, or the like, may be installed on outer diameter surfaces of the first auxiliary wheels 21 and the second auxiliary wheels 22, so the elastic structure may roll and contact the second guide rails 12.

Figure 5:
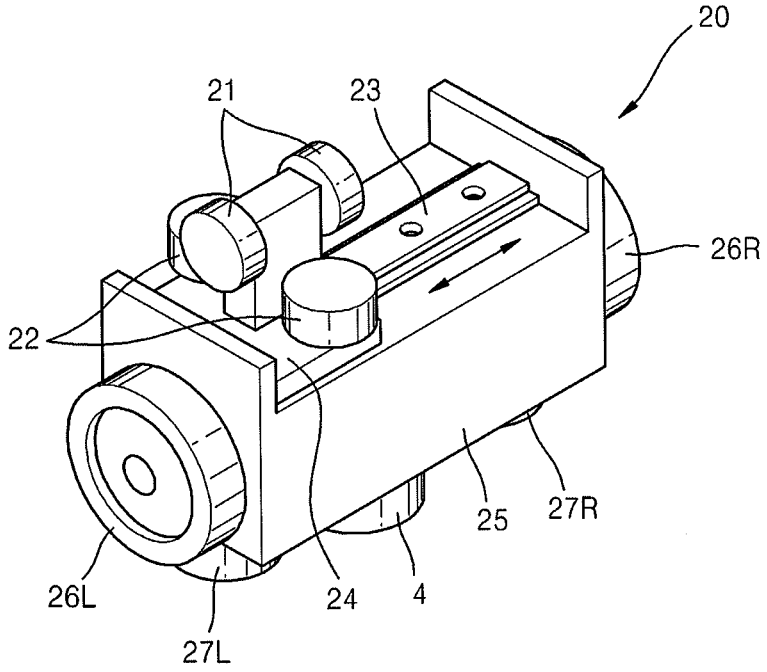
FIG. 5 illustrates a perspective view of a position of a reciprocating support when a traveling unit of FIG. 1 travels in a second direction (left rotation)
Figure 6:
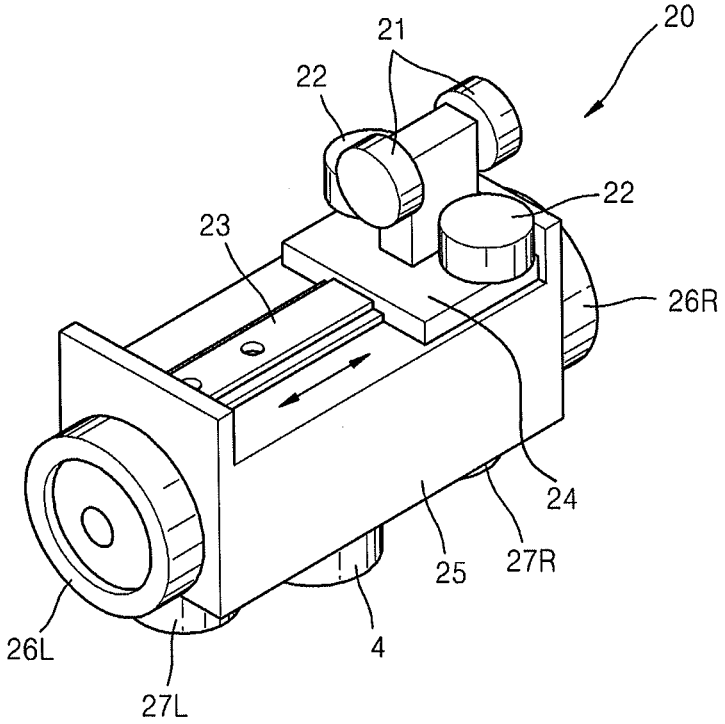
FIG. 6 illustrates a perspective view of a position of the reciprocating support when the traveling unit of FIG. 1 travels in a first direction (straight)
Figure 7:
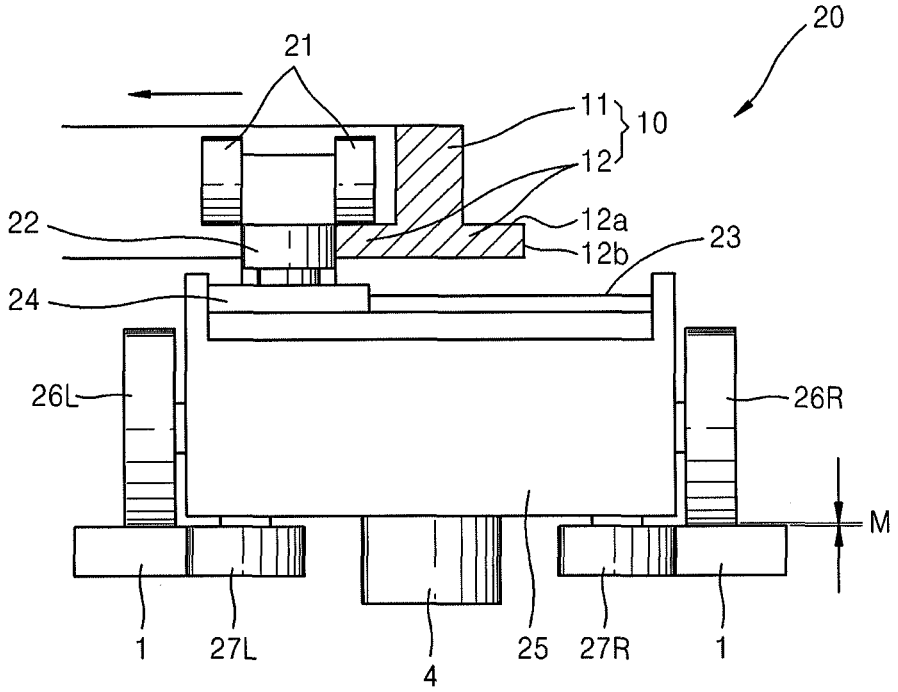
FIG. 7 illustrates a partial cross-sectional view of a traveling state when the traveling unit of FIG. 5 travels in the second direction (left rotation)
Figure 8:
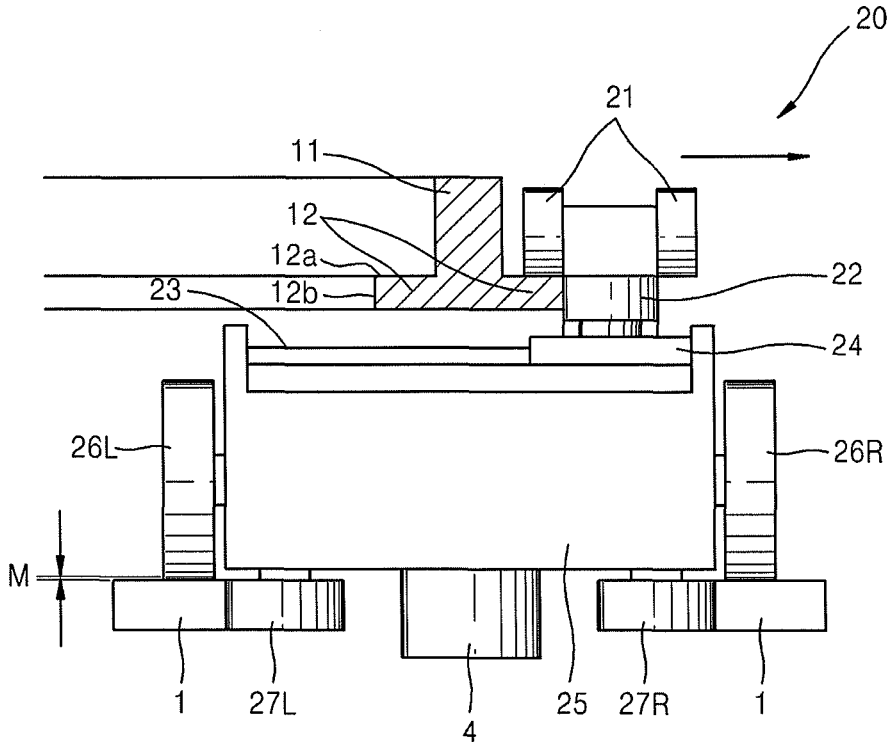
FIG. 8 illustrates a partial cross-sectional view of a traveling state when the traveling unit of FIG. 6 travels in the first direction (straight)

FIG. 5 is a perspective view of a position of a reciprocating support 24 when the traveling unit 20 of FIG. 1 travels in a second direction (left rotation), FIG. 6 is a perspective view of a position of the reciprocating support 24 when the traveling unit 20 of FIG. 1 travels in a first direction (straight), FIG. 7 is a partial cross-sectional view of a traveling state where the traveling unit 20 of FIG. 5 travels in the second direction (left rotation), and FIG. 8 is a partial cross-sectional view of a traveling state where the traveling unit 20 of FIG. 6 travels in the first direction (straight).

As illustrated in FIGS. 5 through 8, the first auxiliary wheels 21 may be installed at right and left sides of the reciprocating support 24 that makes a reciprocating movement along a guide 23 selectively. The second auxiliary wheels 22 may be installed in front of or in the rear of the reciprocating support 24.

In addition, as illustrated in FIGS. 5 through 8, the traveling unit 20 may further include left traveling wheels 26L, right traveling wheels 26R, left traveling auxiliary wheels 27L, and right traveling auxiliary wheels 27R. The left and right traveling wheels 26L and 26R may be installed at left and right sides of a wheel support 25, respectively, and the left and right traveling auxiliary wheels 27L and 27R may be installed at left and right portions, respectively, of a bottom surface of the wheel support 25. As illustrated in FIGS. 1-2, the left and right traveling wheels 26L and 26R may roll on and contact top surfaces of the first direction traveling rails 1 or the second direction traveling rails 2. As illustrated in FIGS. 7-8, the left and right traveling auxiliary wheels 27L and 27R may roll on and contact respective inner side surfaces of the first direction traveling rails 1 or the second direction traveling rails 2. Here, various motors, e.g., linear motors, or various actuators, e.g., solenoids, may be installed at the wheel support 25, and various power transmission devices and driving devices, e.g., driving motors, and the like, may be installed at the wheel support portion 25 in order to rotate the left and right traveling wheels 26L and 26R.

The reciprocating support 24 may be installed on a top surface of the wheel support 25 and may make a reciprocating movement along the guide 23 selectively. The wheel support 25 may rotate along a rotation shaft 4 installed at a traveling leveling cart 3 (FIG. 1).

In addition, the left traveling wheels 26L or the right traveling wheels 26R may be driving wheels that are driven by a motor to which power is supplied via the rails 1 or 2 or other electric wires. Various, well-known traveling driving devices may be used, and thus, a detailed description thereof will be omitted. In addition, various pickup devices or ascending and descending devices that may pick up an accommodation container, e.g., a cassette, a magazine, or the like, in which various accommodation objects, e.g., such as wafers, lead frames, printed circuit boards (PCBs), rings, masks, display panels, or the like, are loaded and may ascend or descend, may be installed at the traveling leveling cart 3. These pickup devices or ascending and descending devices are well-known and thus, a detailed description thereof will be omitted.

Figure 9:
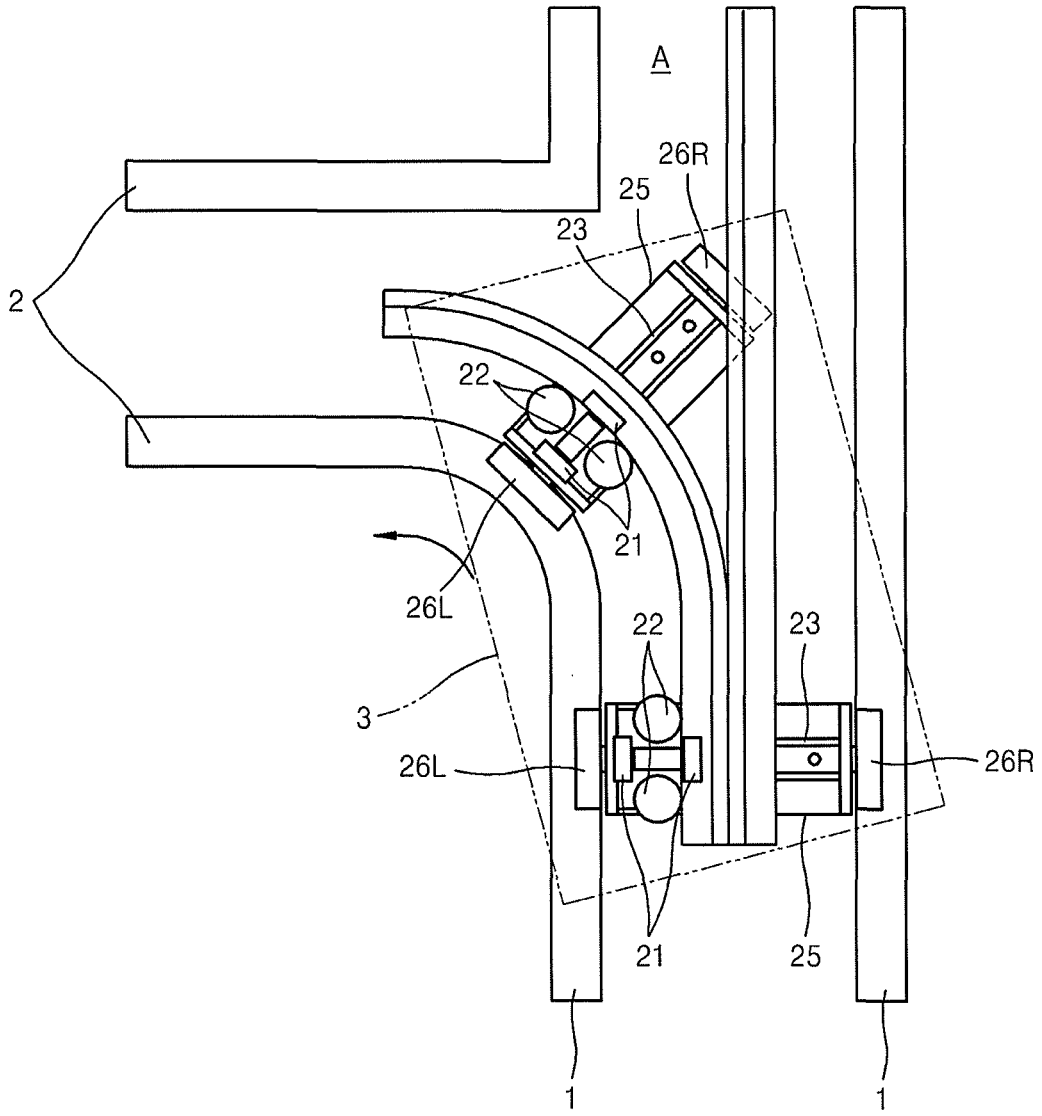
FIG. 9 illustrates a plan view of a traveling state when the traveling unit of FIG. 7 travels in the second direction (left rotation)
Figure 10:
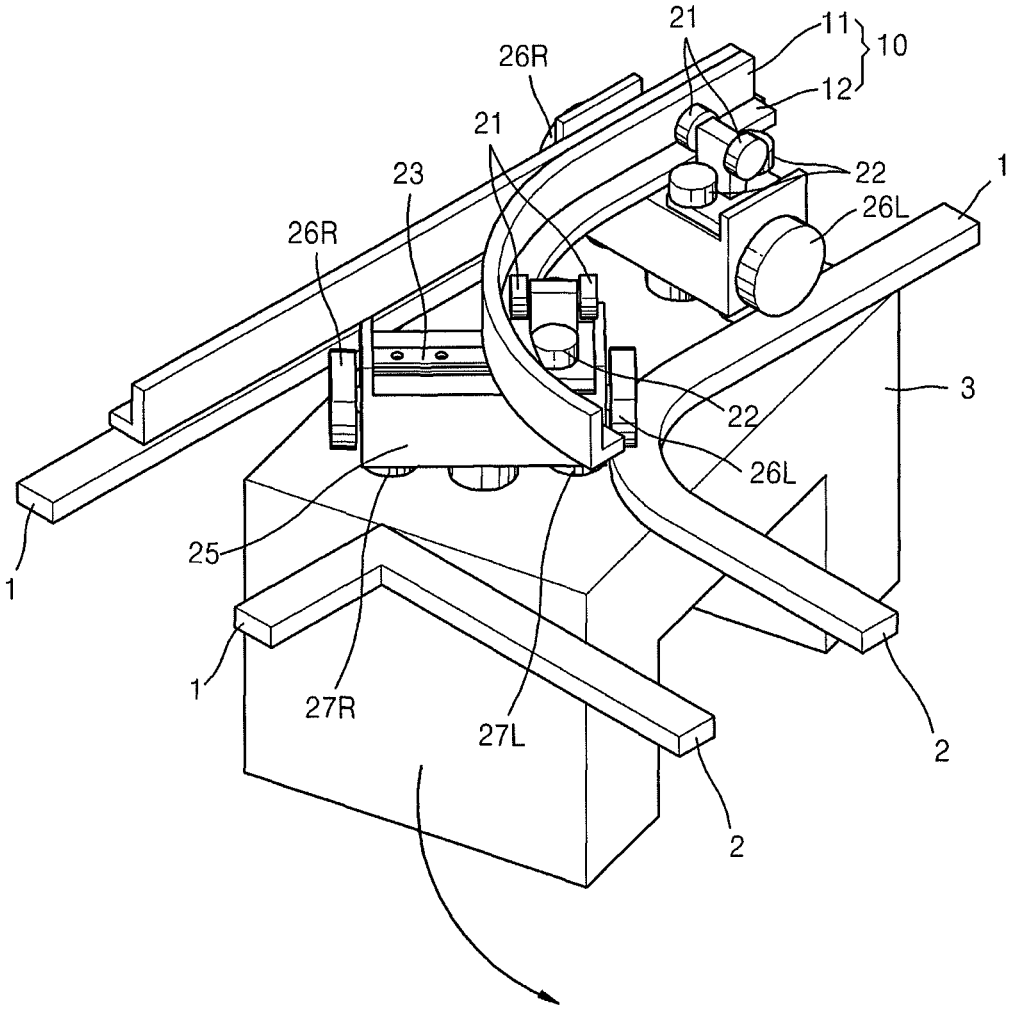
FIG. 10 illustrates a perspective view of FIG. 9.
Figure 11:
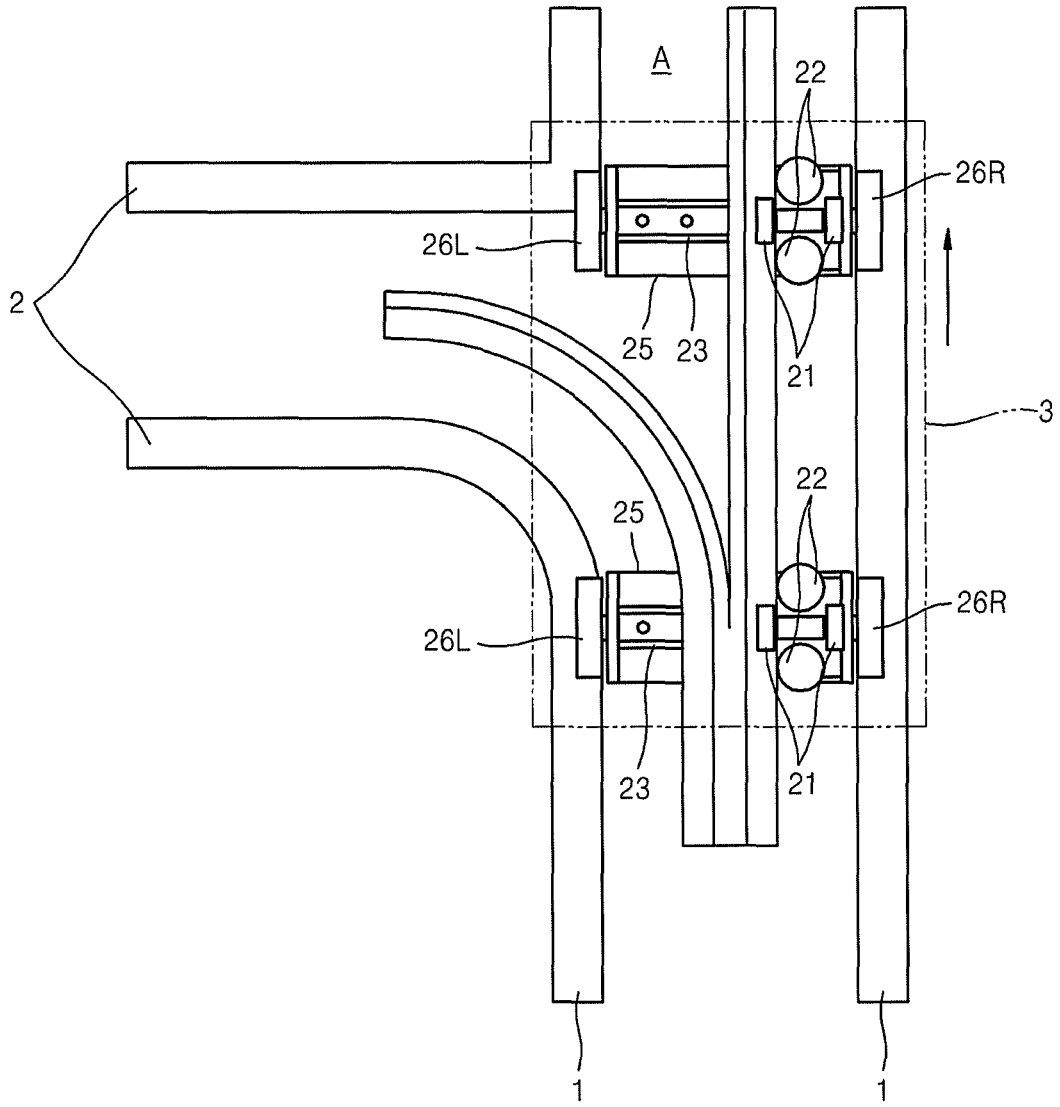
FIG. 11 illustrates a plan view of a traveling state when the traveling unit of FIG. 8 travels in the first direction (straight)
Figure 12:
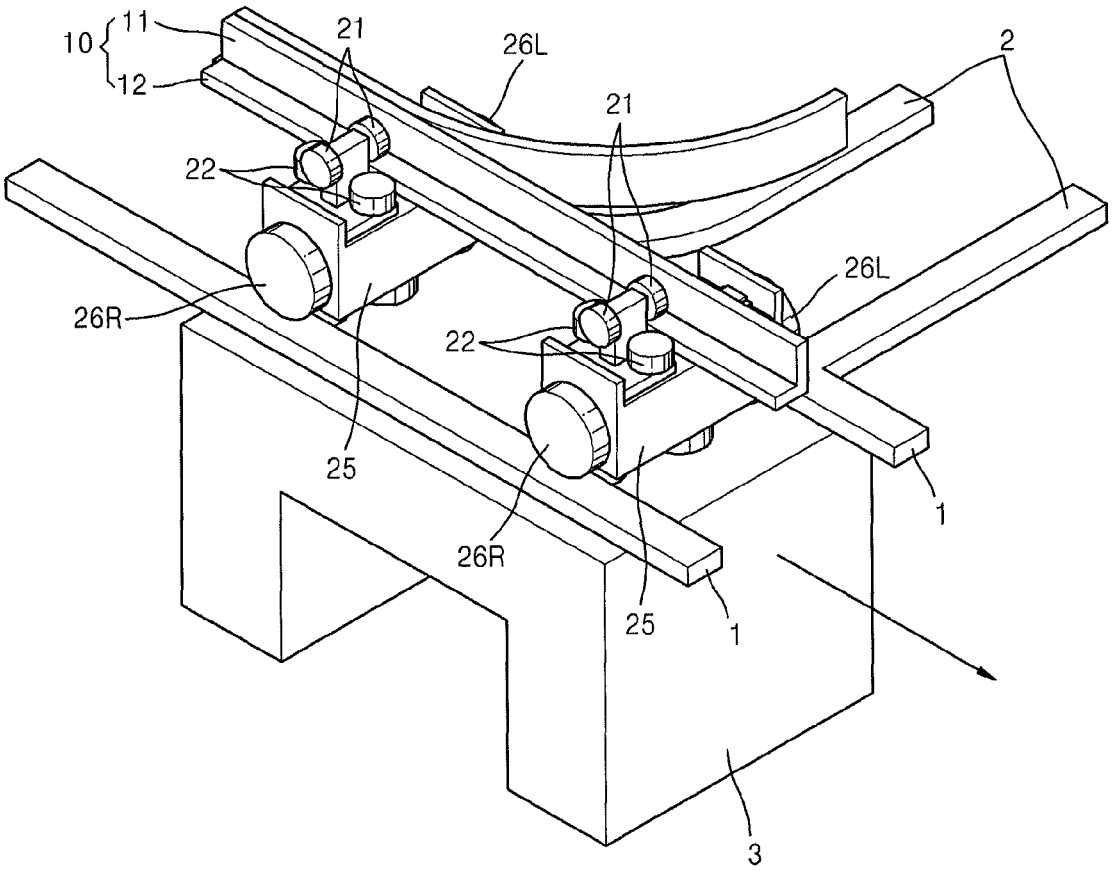
FIG. 12 illustrates a perspective view of FIG. 11.

A branching operation of the hoist apparatus according to embodiments of the inventive concept will be described in greater detail below with reference to FIGS. 9-12. FIG. 9 is a plan view of a traveling state where the traveling unit 20 of FIG. 7 travels in the second direction (left rotation), FIG. 10 is a perspective view of FIG. 9, FIG. 11 is a plan view of a traveling state where the traveling unit 20 of FIG. 8 travels in the first direction (straight), and FIG. 12 is a perspective view of FIG. 11. For example, travel along the first direction may refer to movement along a straight line, i.e., along a linear branch of the guide rail 10 that extends along a straight line, while travel along the second direction may refer to movement along a curved line, i.e., along a curved branch of the guide rail 10 that separates from the linear portion and curves to the left.

First, as illustrated in FIGS. 5, 7, 9, and 10, when the traveling unit 20 travels in the second direction (left rotation), the traveling unit 20 may be positioned to have the first and second auxiliary wheels 21 and 22 on the branch of the guide rails 10 that turn left. That is, the reciprocating support 24 installed at the wheel support 25 of the traveling unit 20 is moved in the left direction, as illustrated in FIG. 7 (see arrow), along the guide 23 before the traveling unit 20 enters in the branch guide rails 10. Subsequently, as illustrated in FIG. 7, when the traveling unit 20 enters in the branch guide rails 10, i.e., contacts and slides onto the branch guide rails 10, a right one of the first auxiliary wheels 21 may roll and contact a left top surface of the second guide rails 12 of the branch guide rails 10. In this case, the left traveling wheels 26L that allow the second guide rails 12 to roll and support the first auxiliary wheels 21 in a vertical direction and simultaneously guide the second guide rails 12 to be rotated in left direction, may roll and contact the second direction traveling rails 2 bent from the first direction traveling rails 1.

Even when a minute interval M (FIG. 7) is formed between the right traveling wheels 26R and the first direction traveling rails 1, e.g., during rotation to the left, such a minute interval does not affect movement of the right traveling wheels 26R during rotation to the left. That is, as illustrated in FIG. 9-10, while the left traveling wheels 26L are continuously contacting the traveling rails, i.e., continuously move from the first to the second direction traveling rail 2, the right traveling wheels 26R are discontinuously positioned on the traveling rails, i.e., the right traveling wheels 26R are in the air for a predetermined time without contacting either of the first or second direction traveling rails 2. In this case, a load of a transfer object or the traveling leveling cart 3 is concentrated on the left traveling wheels 26L and the first auxiliary wheels 21, so during transfer of the right traveling wheels 26R from the first to the second direction traveling rail 2, a load does not occur in the right traveling wheels 26R. That is, since the second guide rails 12 extend in the horizontal direction and support the first auxiliary wheels 21 in the vertical direction securely, vertical vibration during branching and traveling may be prevented, and traveling may be performed more stably and quickly.

Furthermore, the second auxiliary wheels 22 may roll and contact the left side of the second guide rails 12, and the left traveling auxiliary wheels 27L may roll and contact the sides of the first direction traveling rails 1 and the second direction traveling rails 2 so that left and right vibration during branching and traveling may also be prevented and traveling may be performed more stably and quickly. In addition, due to secure rolling and contact in up, down, right, and left directions, the traveling unit 20 may pass through the branch point A at high speed, quickly, and safely without reducing speed when branching and traveling.

As illustrated in FIGS. 6, 8, 11, and 12, when the traveling unit 20 travels in the first direction (straight), the traveling unit 20 may be positioned to have the first and second auxiliary wheels 21 and 22 on the branch of the guide rails 10 that extends linearly along a straight line. That is, the reciprocating support 24 installed at the wheel support 25 of the traveling unit 20 is moved in right direction, as illustrated in FIG. 8 (see arrow), along the guide 23 before the traveling unit 20 enters in the branch guide rails 10. Subsequently, as illustrated in FIG. 8, when the traveling unit 20 enters the branch guide rails 10, a left one of the first auxiliary wheels 21 may roll and contact a right top surface of the second guide rails 12 of the branch guide rails 10. In this case, the right traveling wheels 26R that allow the second guide rails 12 to roll and support the first auxiliary wheels 21 in a vertical direction and simultaneously guide the second guide rails 12 to travel straight, may roll and contact the first direction traveling rails 1.

Even when a minute interval M of FIG. 8 is formed between the left traveling wheels 26L and the first direction traveling rails 1, the left traveling wheels 26L may jump on the first direction traveling rails 1, i.e., may contact the rail discontinuously as discussed previously with reference to movement along the left-branching guide rail, like the left traveling wheels 26L illustrated in FIG. 11 or 12. In this case, a load of a transfer object or the traveling leveling cart 3 is concentrated on, e.g., applied to, the right traveling wheels 26R and the first auxiliary wheels 21, and while the left traveling wheels 26L are jumped, a load does not occur in the left traveling wheels 26L. That is, since the second guide rails 12 extend in the vertical direction and support the first auxiliary wheels 21 in the first direction securely and continuously, vertical vibration during branching and traveling may be prevented, and traveling may be performed more stably and quickly.

Furthermore, the second auxiliary wheels 22 may roll and contact the right side of the second guide rails 12, and the right traveling auxiliary wheels 27R may roll and contact the side of the first direction traveling rails 1 so that horizontal vibration during branching and traveling may also be prevented and traveling may be performed more stably and quickly. In addition, due to secure rolling and contact in up, down, right, and left directions, the traveling unit 20 may pass through the branch point A at high speed, quickly, and safely without reducing speed when branching and traveling. In other words, as the auxiliary wheels of the traveling unit 20 contact only external side surfaces of a single branch of the branching guide rails 10, and as a larger load is applied to the traveling unit 20 above the auxiliary wheels, the traveling unit 20 may move smoothly and continuously along the external side surfaces of the single branch without being affected by the branching of the guide rail.

Figure 13:
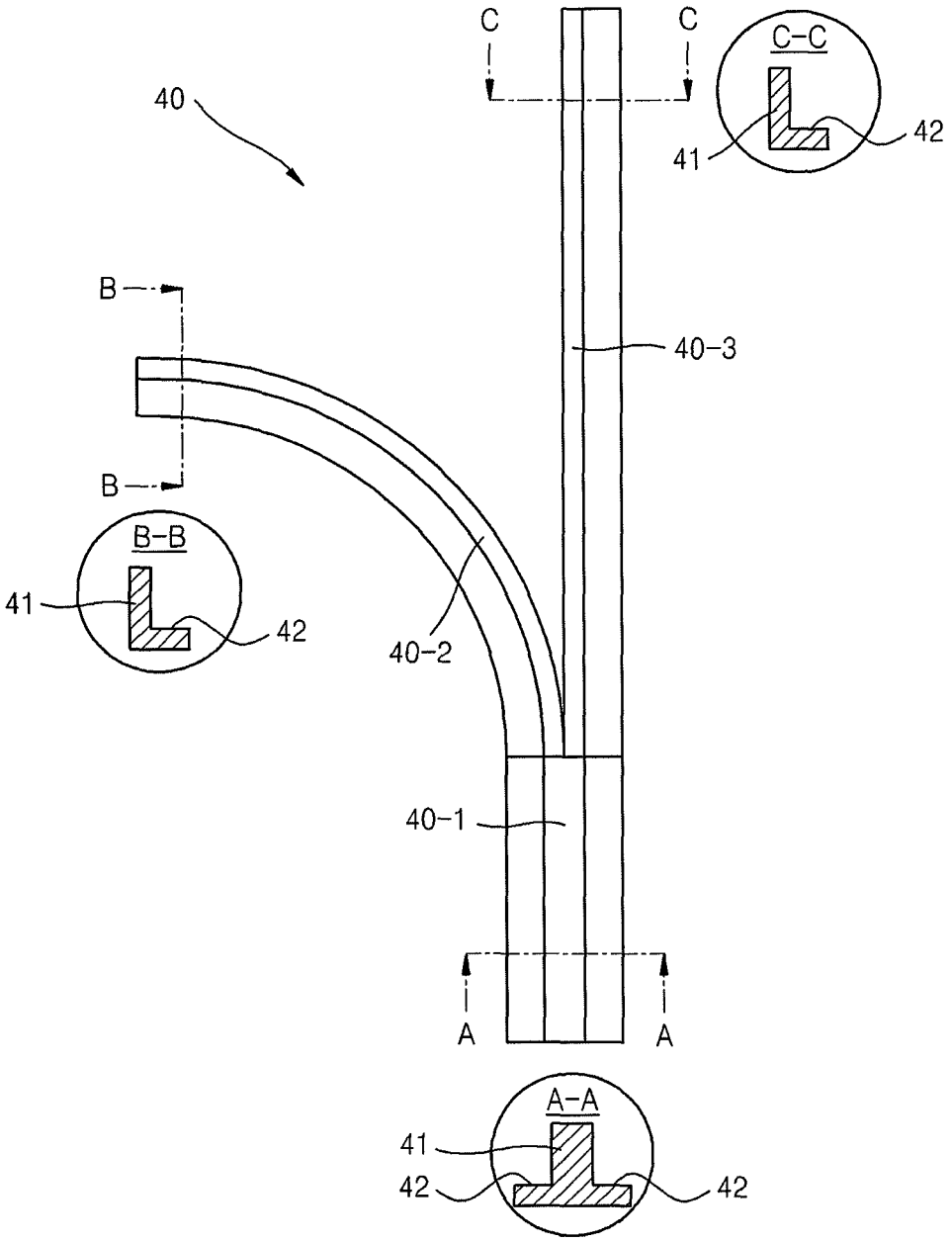
FIG. 13 illustrates a plan view of branch guide rails of a hoist apparatus according to an embodiment of the inventive concept.

FIG. 13 is a plan view of branch guide rails 40 in a hoist apparatus according to another embodiment of the inventive concept.

As illustrated in FIG. 13, the branch guide rails 40 may include a member 40-1 having a cross-section that is reverse T-shaped, like a cross-section taken along a line A-A, and two members 40-2 and 40-3 each having a cross-section that is L-shaped, like cross-sections taken along a line B-B and a line C-C, which are connected to each other by using bolts, nuts, screws, rivets, welding, compression, adhering, or the like.

Thus, at the member 40-1 having a reverse T-shaped cross-section, second guide rails 42 having a cross-section extending in the horizontal direction may be formed at right and left sides of a first guide rail 41 having a cross-section extending in the vertical direction. As each of two members 40-2 and 40-3 has an L-shaped cross-section, the second guide rails 42 having a cross-section extending in the horizontal direction may be formed at a left or right side of the first guide rail 41 having a cross-section extending in the vertical direction. In other words, as opposed to the branch guide rail 10 in FIGS. 1-12, which is a single integral unit, the branch guide rails 40 are formed of three separate pieces, i.e., elements 40-1 through 40-3, that are connected to each other via connection members.

Figure 14:
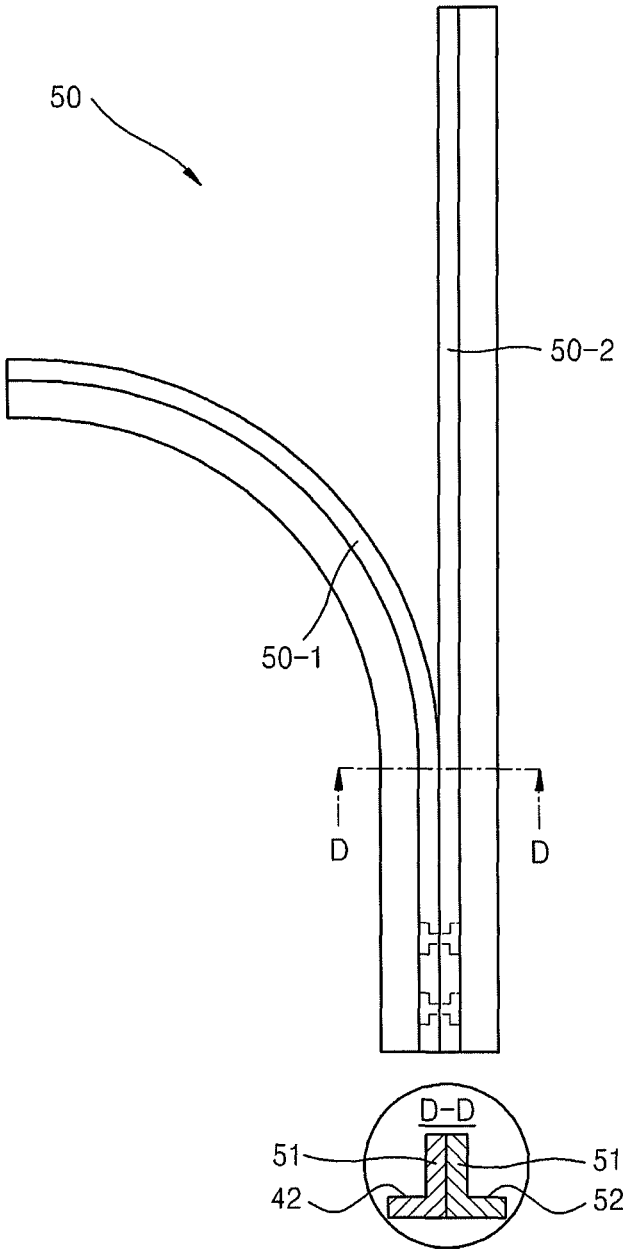
FIG. 14 illustrates a plan view of branch guide rails of a hoist apparatus according to another embodiment of the inventive concept.

FIG. 14 is a plan view of branch guide rails 50 of a hoist apparatus according to another embodiment of the inventive concept.

Referring to FIG. 14, the branch guide rails 50 may include two members connected to each other. That is, the branch guide rails 50 may connect two members 50-1 and 50-2 each having an L-shaped cross-section, like a cross-section taken along a line D-D, by facing portions of the members 50-1 and 50-2 by using bolts, nuts, screws, rivets, welding, compression, adhering, or the like. Thus, as each of the two members 50-1 and 50-2 has an L-shaped cross-section, second guide rails 52 having a cross-section extending in the horizontal direction may be formed at a left or right side of first guide rails 51 having a cross-section extending in the vertical direction.

Figure 15:
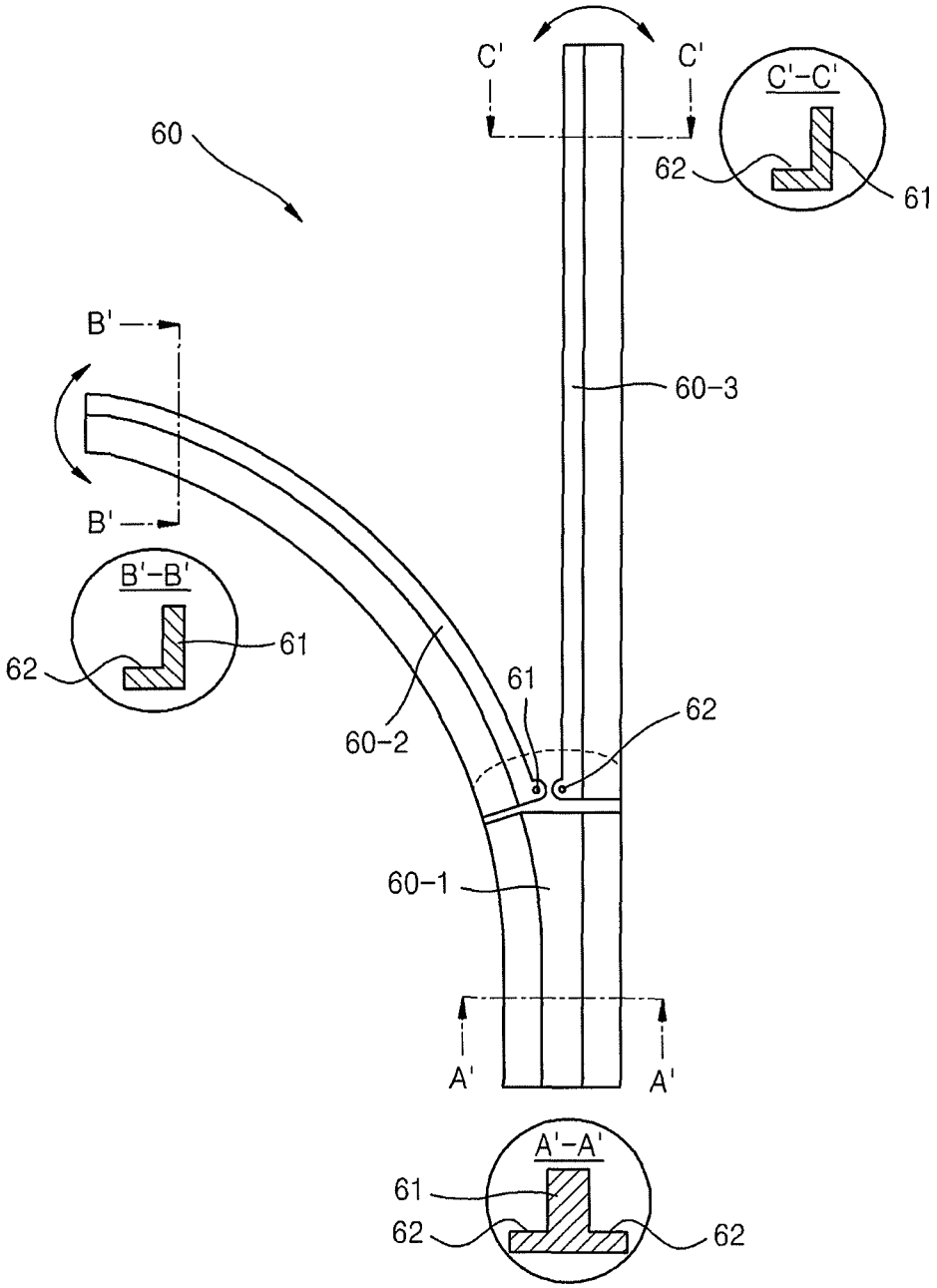
FIG. 15 illustrates a plan view of branch guide rails of a hoist apparatus according to another embodiment of the inventive concept.

FIG. 15 is a plan view of branch guide rails 60 of a hoist apparatus according to another embodiment of the inventive concept.

As illustrated in FIG. 15, the branch guide rails 60 may hinge-connect two members 60-2 and 60-3 each having an L-shaped cross-section to a member 60-1 having a cross-section that is reverse T-shaped, so that the two members 60-2 and 60-3 each having an L-shaped cross-section, like cross-sections taken along lines B'-B' and C'-C' may rotate around hinge shafts 61 and 62 of the member 60-1 having a reverse T-shaped cross-section, like a cross-section taken along a line A'-A'. Thus, at the member 60-1 having a reverse T-shaped cross-section, second guide rails 62 having a cross-section extending in the horizontal direction may be formed at a left or right side of first guide rails 61 having a cross-section extending in the vertical direction, and at the two members 60-2 and 60-3 each having an L-shaped cross-section, second guide rails 62 having a cross-section extending in the horizontal direction may be formed at a left or right side of first guide rails 61 having a cross-section extending in the horizontal direction.

In addition, the two members 60-2 and 60-3 each having an L-shaped cross-section are connected to rails that rotate around the hinges 61 and 62 of the member 60-1 having a reverse T-shaped cross-section and are adjacent to each other, twisted positions of the two members 60-2 and 60-3 each having an L-shaped cross-section may be simply fitted and adjusted on the spot.

The branch guide rails 10, 40, 50, and 60 illustrated in FIG. 1 and FIGS. 13 through 16 include a straight path formed in a straight line and a left rotation path branching out into a left side from the straight path based on a proceeding direction. However, the branch guide rails 10, 40, 50, and 60 of FIG. 1 and FIGS. 13 through 16 may include a right rotation path as well as the straight path and the left rotation path and may be modified in various shapes.

While the inventive concept has been particularly shown and described with reference to exemplary embodiments thereof, it will be understood that various changes in form and details may be made therein without departing from the spirit and scope of the following claims.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A hoist apparatus, comprising: branch guide rails with a branch point, the branch point defining a branching point between first and second traveling rails, and the branch guide rails including: first guide rails having a cross-section in a first direction, and second guide rails having a cross-section in a second direction and connected to the first guide rails; and a traveling unit configured to travel along the branch guide rails, the traveling unit including first auxiliary wheels configured to roll and contact a first side of the second guide rails, wherein the first side of the second guide rails is a top surface of the second guide rails.

2. The hoist apparatus as claimed in claim 1, wherein:

the first guide rails include vertical guide rails having a cross-section extending in a vertical direction, and the second guide rails include horizontal guide rails having a cross-section extending in a horizontal direction, cross-sections of the first guide rails and the second guide rails being reverse T-shaped.

3. The hoist apparatus as claimed in claim 1, wherein the first auxiliary wheels include vertical wheels that stand in a vertical direction.

4. The hoist apparatus as claimed in claim 1, wherein the first auxiliary wheels are at left and right sides of a reciprocating support, the reciprocating support being configured to make a reciprocating movement along a guide selectively.

5. The hoist apparatus as claimed in claim 1, wherein the traveling unit further comprises second auxiliary wheels configured to roll and contact a second side of the second guide rails.

6. The hoist apparatus as claimed in claim 5, wherein the second side of the second guide rails is a side surface of the second guide rails, the second auxiliary wheels being horizontal wheels that stand in a horizontal direction.

7. The hoist apparatus as claimed in claim 5, wherein the second auxiliary wheels are installed at a reciprocating support, the reciprocating support being configured to make a reciprocating movement along a guide selectively.

8. The hoist apparatus as claimed in claim 1, wherein the first and second traveling rails of the branch guide rails include a linear path and a curved path turning away from the linear path, respectively.

9. The hoist apparatus as claimed in claim 1, wherein the traveling unit further comprises:

a wheel support connected to a traveling leveling cart;

left traveling wheels and right traveling wheels at left and right sides of the wheel support, respectively, the left and right traveling wheels being configured to roll and contact the first direction traveling rails or the second direction traveling rails; and a reciprocating support configured to make a reciprocating movement along a guide, the reciprocating support bring on a top surface of the wheel support.

10. The hoist apparatus as claimed in claim 1, wherein the second guide rails include inclined surfaces, a thickness of central portions of the second guide rails being gradually reduced toward edges of the second guide rails.

11. The hoist apparatus as claimed in claim 1, wherein the branch guide rails are configured by connecting two members having L-shaped cross-sections to a member having a reverse T-shaped cross-section.

12. The hoist apparatus as claimed in claim 1, wherein the branch guide rails are configured by connecting two members having L-shaped cross-sections.

13. The hoist apparatus as claimed in claim 1, wherein the branch guide rails are configured by hinge-connecting two members having L-shaped cross-sections to a member having a reverse T-shaped cross-section, the two L-shaped members being configured to rotate around hinge shafts of the reverse T-shaped member.

14. A hoist apparatus, comprising:

branch guide rails with a branch point, the branch point defining a branching point between first and second traveling rails, and the branch guide rails including:

vertical guide rails having a cross-section in a vertical direction, and horizontal guide rails having a cross-section in a horizontal direction and connected to the vertical guide rails; and a traveling unit configured to travel along the branch guide rails, the traveling unit including vertical wheels configured to roll and contact a top surface of the second guide rails, and horizontal wheels configured to roll and contact a side surface of the second guide rails.

15. A hoist apparatus, comprising:

branch guide rails with a branch point, the branch point defining a branching point between first and second traveling rails, and the branch guide rails including:

first guide rails branching into two directions at the branch point, and second guide rails on the first guide rails, the second guide rails branching into two directions at the branch point and being perpendicular to the first guide rails; and a traveling unit configured to travel along the branch guide rails, the traveling unit including auxiliary wheels positioned to contact only one side of the branch guide rails.

16. The hoist apparatus as claimed in claim 15, wherein the traveling unit includes first and second auxiliary wheels, the first auxiliary wheels contacting only one side surface of the branch guide rails, and the first auxiliary wheels contacting only one top surface of the branch guide rails.

17. The hoist apparatus as claimed in claim 16, wherein the first and second auxiliary wheels are at a first side of the traveling unit, the first and second auxiliary wheels being in continuous contact with the branch guide rails.

18. The hoist apparatus as claimed in claim 17, wherein a second side of the traveling unit is in non-continuous contact with the branch guide, the second side of the traveling unit being opposite the first side of the traveling unit.

19. The hoist apparatus as claimed in claim 15, wherein a thickness of the second guide rails is gradually reduced at terminal edges facing away from the branch point.

* * * * *